US006708748B1

(12) United States Patent
Kronseder et al.

(10) Patent No.: US 6,708,748 B1
(45) Date of Patent: Mar. 23, 2004

(54) BEVERAGE CAN WITH A PROTECTIVE COVER, A BLANK FOR A PROTECTIVE COVER, AS WELL AS A METHOD AND DEVICE FOR APPLICATION OF A PROTECTIVE COVER TO BEVERAGE CANS

(75) Inventors: Volker Kronseder, Neutraubling (DE); Stephan Maschke, Neutraubling (DE); Reinhold Spindler, Sünching (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 09/786,150

(22) PCT Filed: Jul. 20, 2000

(86) PCT No.: PCT/EP00/06929

§ 371 (c)(1),
(2), (4) Date: Jun. 4, 2001

(87) PCT Pub. No.: WO01/23267

PCT Pub. Date: Apr. 5, 2001

(30) Foreign Application Priority Data

Sep. 30, 1999 (DE) ..... 199 47 273
Nov. 25, 1999 (DE) ..... 199 56 784

(51) Int. Cl.[7] ..... B65C 9/08

(52) U.S. Cl. ..... 156/570; 53/411; 53/129.1; 220/256.1; 220/257.2; 220/258.3; 220/718; 220/359.2; 220/716

(58) Field of Search ..... 215/230, 232; 206/459.5, 460; 40/628, 630, 310, 311; 220/257.1, 257.2, 258.1, 258.2, 258.3, 359.1, 359.2, 359.4, 716, 718, 906; 156/69, 320–322, 308.4, 309.09, 499, 556, 569, 570, 475; 53/411, 441, 484, 129.1, 131.1, 137.1, 137.2, 138.1, 341, 329, 329.3, 330, 375.8

(56) References Cited

U.S. PATENT DOCUMENTS 2,634,012 A * 4/1953 Copeman ..... 156/183
3,800,502 A * 4/1974 Vermeulen ..... 53/329.2

(List continued on next page.)

FOREIGN PATENT DOCUMENTS

| | | | |
|---|---|---|---|
| DE | 39 070380 A1 | * | 3/1990 |
| DE | 3528903 | * | 2/1997 |
| DE | 19711391 | | 7/1998 |
| DE | 19704148 | | 8/1998 |
| DE | 29812169 | | 9/1999 |
| DE | 200 03 282 U1 | * | 5/2000 |
| DE | 10037096 | * | 2/2002 |
| EP | 0816248 | | 1/1998 |
| GB | 2267082 | | 11/1993 |
| WO | WO 96/26866 | * | 9/1996 |
| WO | WO 97/00207 | * | 1/1997 |

OTHER PUBLICATIONS

English translation of Bruun, DE 35 28 903 A1.

*Primary Examiner*—Robin A. Hylton
(74) *Attorney, Agent, or Firm*—Marshall, Gerstein & Borun LLP

(57) ABSTRACT

A beverage can with a protective cover, a blank for it, as well as a method and device for application of a protective cover to the lid area of a beverage can, wherein the protective cover is made of embossed aluminum foil. An essentially flat blank of the embossed aluminum foil, while covering at least the can lid, is brought into contact with the beverage can and, while being shaped in a ductile manner, is molded to at least the can lid. The cans, while in an upright position, are conveyed with a conveyor apparatus beneath a placement apparatus for blanks made of embossed aluminum foil, which placement apparatus places the blanks onto the top area of the cans while pressing them, at least partially, against the lid area and/or the can edge.

7 Claims, 7 Drawing Sheets

U.S. PATENT DOCUMENTS 4,065,909 A * 1/1978 Mueller ..... 53/129.1
4,151,698 A * 5/1979 Muller et al. ..... 53/131.3
4,216,050 A * 8/1980 Schmit ..... 156/494
4,230,518 A 10/1980 Fähnrich
4,270,335 A * 6/1981 Dardaine ..... 53/411
4,708,257 A * 11/1987 Deline ..... 220/257.2
4,814,031 A 3/1989 Zodrow
4,927,048 A * 5/1990 Howard ..... 215/232
D383,978 S * 9/1997 Loeb ..... D9/438
5,996,832 A * 12/1999 Nieuwoudt ..... 206/217
6,104,013 A * 8/2000 Miller ..... 219/633
6,336,309 B1 * 1/2002 Groppi ..... 53/290

* cited by examiner

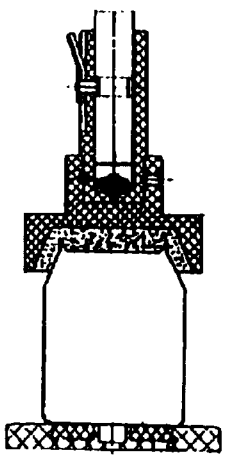
FIG. 4.3
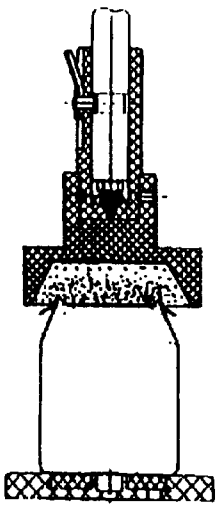
FIG. 4.2
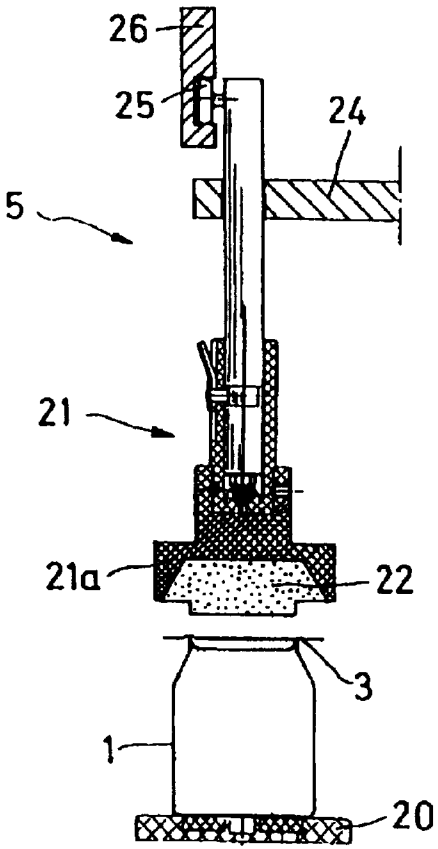
FIG. 4.1

BEVERAGE CAN WITH A PROTECTIVE COVER, A BLANK FOR A PROTECTIVE COVER, AS WELL AS A METHOD AND DEVICE FOR APPLICATION OF A PROTECTIVE COVER TO BEVERAGE CANS

FIELD OF THE INVENTION

The invention relates to a beverage can with a protective cover, a blank for a protective cover, as well as a method and device for application of a protective cover to beverage cans.

BACKGROUND OF THE INVENTION

To prevent the accumulation of dust, liquids, or similar contamination on the surface and in the recesses of the can lid of filled and closed beverage cans, and to thereby provide for hygienic draining of the cans after opening, the use of a wide variety of designs of protective caps made of plastic or similar materials than can be snapped onto cans has already been proposed.

The disadvantages of these solutions are the considerable additional costs, the disturbance of the appearance of beverage cans to which the user is accustomed, the diminished stacking capacity and resulting pallet stacking capacity, and the limited options for precisely matching these protective caps to the remaining appearance of the can in terms of both coloring and printed image.

SUMMARY OF THE INVENTION

The object of the invention is to provide a particularly cost-effective protective cover for beverage cans, a blank for it, as well as method and device for application of this protective cover to beverage cans.

This object is solved with thin metal foil, especially tin foil or aluminum foil, which is applied to the top of a closed beverage can and completely covers its lid surface. Preferably, the dimensions of the tin foil should he designed in such a way as to ensure that the tin foil also wraps around the flange between the can lid and the can body. In the case of beverage cans with a radially inward-shaped shoulder surface, this surface can advantageously be covered by the tin foil, as well. The tin foil can advantageously be shaped to conform directly to the lid or shoulder contour by being pressed against it with sponges, brushes, or similar objects. To improve the hold of the tin foil, the tin foil can, according to a modification of the invention, be at least partially secured to the can, e.g., along the raised flange and/or at the center of the lid, with an adhesive that is safe for use with food. It is also conceivable to apply adhesive bonds in the edge zones only of a tin foil blank, such as at the corners of a square blank.

As an adhesive, a liquid glue can be used that is applied to either the back side of the blank and/or to the can immediately before the blank is applied to the can. To apply the adhesive, glue-compatible contact surfaces can be used whose surface is provided with raised or recessed structures to correspond to the desired glue pattern. Such contact surfaces are used to remove individual blanks for a supply container.

An alternative embodiment comprises blanks with a adhesive coating that can be activated (in its entirely or in parts). Depending on the adhesive coating used, activation can occur by heating or moistening the blanks and/or the cans.

is also advantageous to manufacture the foil used for dust protection and the can from the same material, e.g., aluminum, which simplifies recycling. Another advantage of this approach consists in the fact that the foil can be pulled away easily from the top of the can and, once the can has been emptied, can be compressed and thrown into the interior of the can. This ensures environmentally compatible disposal of the protective cover.

BRIEF DESCRIPTION OF THE DRAWINGS

Additional advantageous embodiments of the invention are the object of the subclaims.

Several sample executions will be explained below on the basis of the following figures:

FIG. 4.1 to FIG. 4.3 depicts a side view of a part of a carousel of the to outfitting machine according to FIG. 2 in various operating positions.

DETAILED DESCRIPTION OF THE PREFERRED EMBODIMENTS

Figure 1:
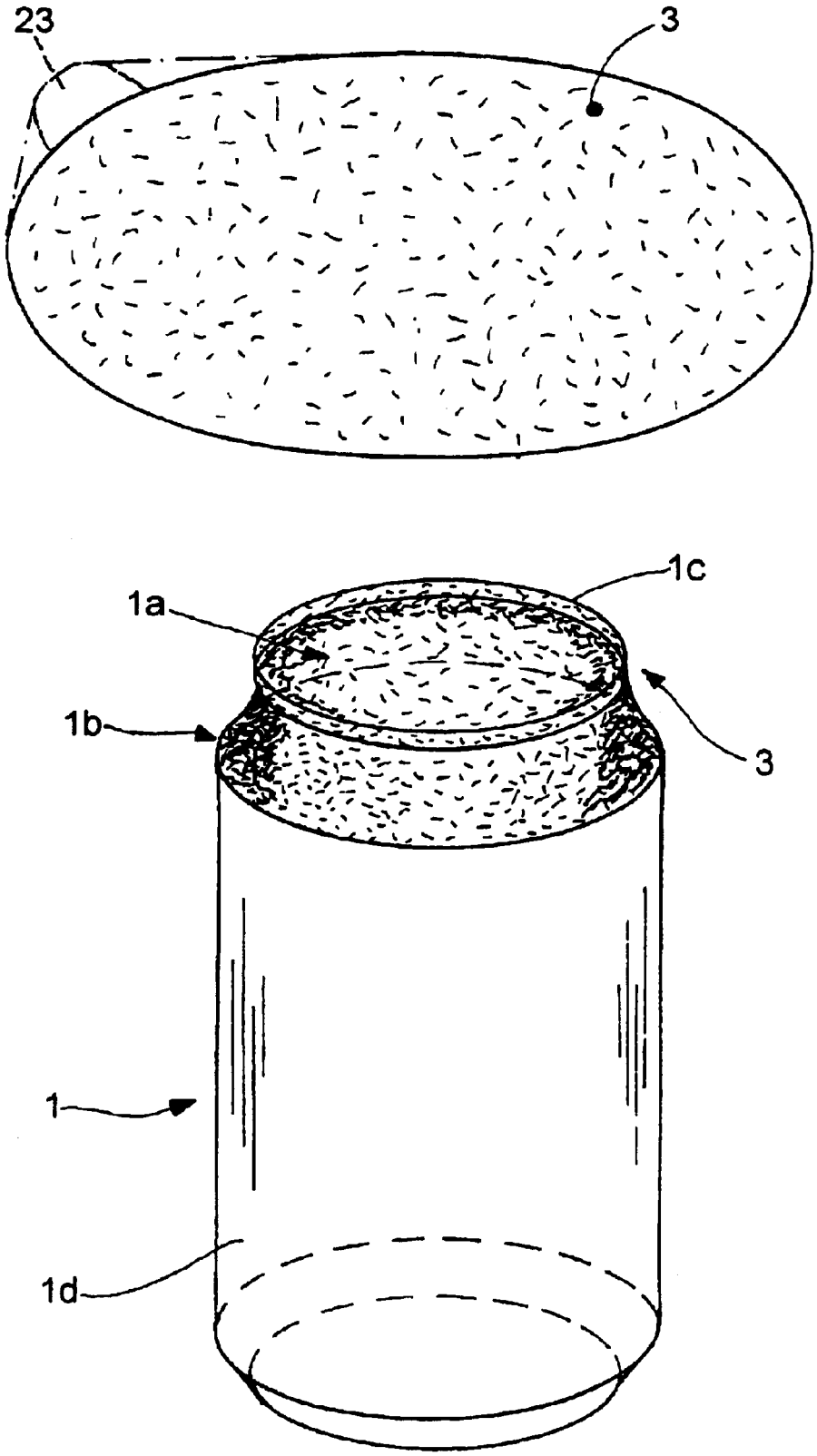
FIG. 1 depicts a beverage can with a protective cover.

FIG. 1 depicts a beverage can 1 for beer, cola, or similar beverages whose top section, i.e., lid surface 1*a* and recessed shoulder surface 1*b*, is completely covered with a thin metal protective cover 3. Above the beverage can, the protective cover 3 is depicted in its original form, which it exhibits before it is applied and molded to a beverage can. In this particular execution, the protective cover 3 features a circular outer contour, with its outer diameter configured to ensure that, once the foil has been molded to the top of the can, the protective cover 3 covers not only the lid surface 1*a*, but also the flange 1*c* between the lid 1*a* and the can body 1*c*, as well as the adjacent diagonal shoulder surface 1*b* up to transition into the cylindrical area of the can body 1*d*.

The protective cover 3 consists of non-laminated aluminum foil with a thickness of 10 micrometers, and features vermicular embossing with a depth of 80 micrometers. The upward-directed face of the aluminum foil is, for example, imprinted to match the coloring of the can body, and can feature additional information or advertising imprints.

The aforementioned vermicular embossing of the foil provides it with outstanding ductility and permits perfect conformity to the spatial curvature in the bowl-shaped area of the can lid la and the diagonal shoulder surface 1*b* of the beverage can. Careful compression and shaping of the protective cover 3 to the can contour alone provides for an adequate positive fit. If necessary, however, an adhesive can be applied, at least intermittently, between the protective cover and the can, e.g., on the upward-protruding flange 1*c* between the can lid I a and the can body 1*d*. An adhesive that is safe for use with food, such as Lesso VN 6349, should be used for this purpose. This adhesive is used only for fixing purposes, and is applied so thinly that no detectable or palpable adhesive residues remain on the can after removal of the protective cover 3.

Figure 2:
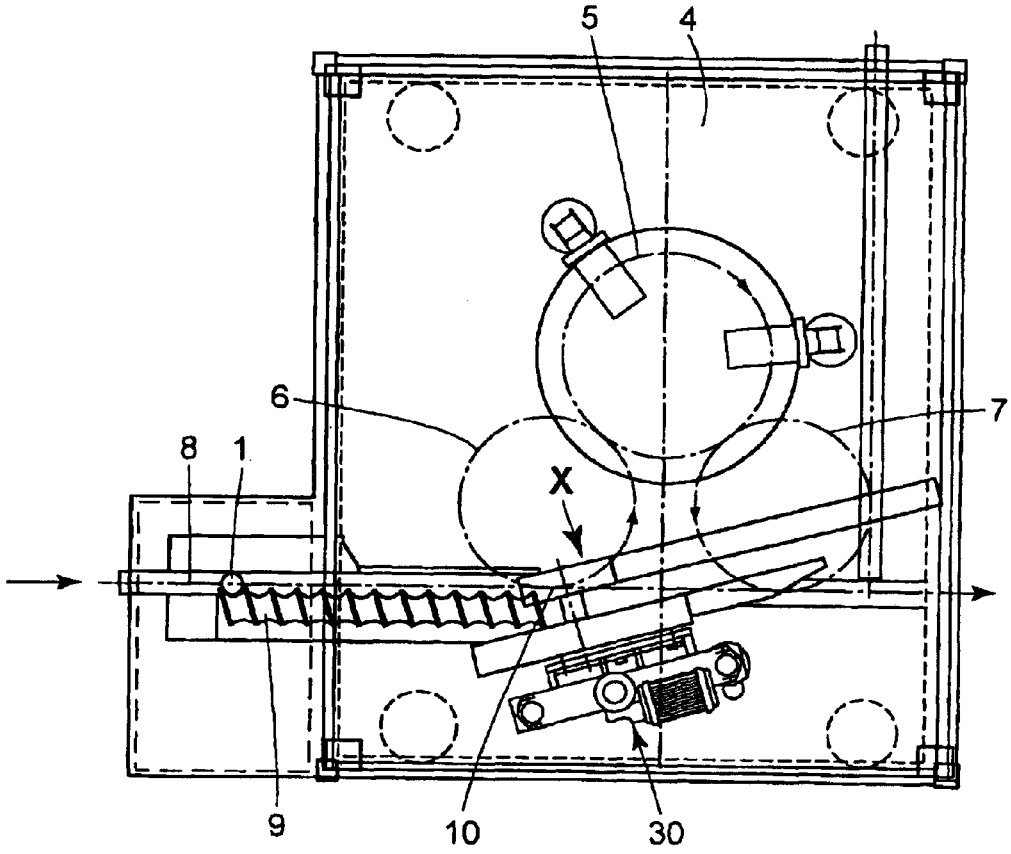
FIG. 2 depicts a schematic aerial view of an outfitting machine for applying the protective cover to beverage cans.

FIG. 2 depicts a schematic aerial view of an outfitting machine 2 suitable for application of such protective covers 3. A carousel 5, a feeding star wheel 6, and a discharging star wheel 7 are pivoted on a slab 4 of the machine, with the two star wheels touching the circumference of the carousel 5. A conveyor belt 8 touching the two star wheels 6 and 7 is provided to feed and discharge the cans 1. A sorting screw 9 is located in the area in front of the feeding star wheel 6 and in parallel to the conveyor belt 8. In proximity to the point of can transfer from the sorting screw 9 to the feeding star wheel 6, a transfer apparatus 10 for transferal of the protective cover 3 is positioned at a distance above the conveyor belt 8 and the feeding star wheel 6. To make it adjustable for various can heights, the transfer apparatus 10 runs on height-adjustable bearings by means of a device 26 powered by an electrical motor.

All of the above-listed can transport elements of the machine and the transfer apparatus 10 can be driven in a continuously synchronous and reciprocally positioned manner by a driving mechanism.

Figure 3:
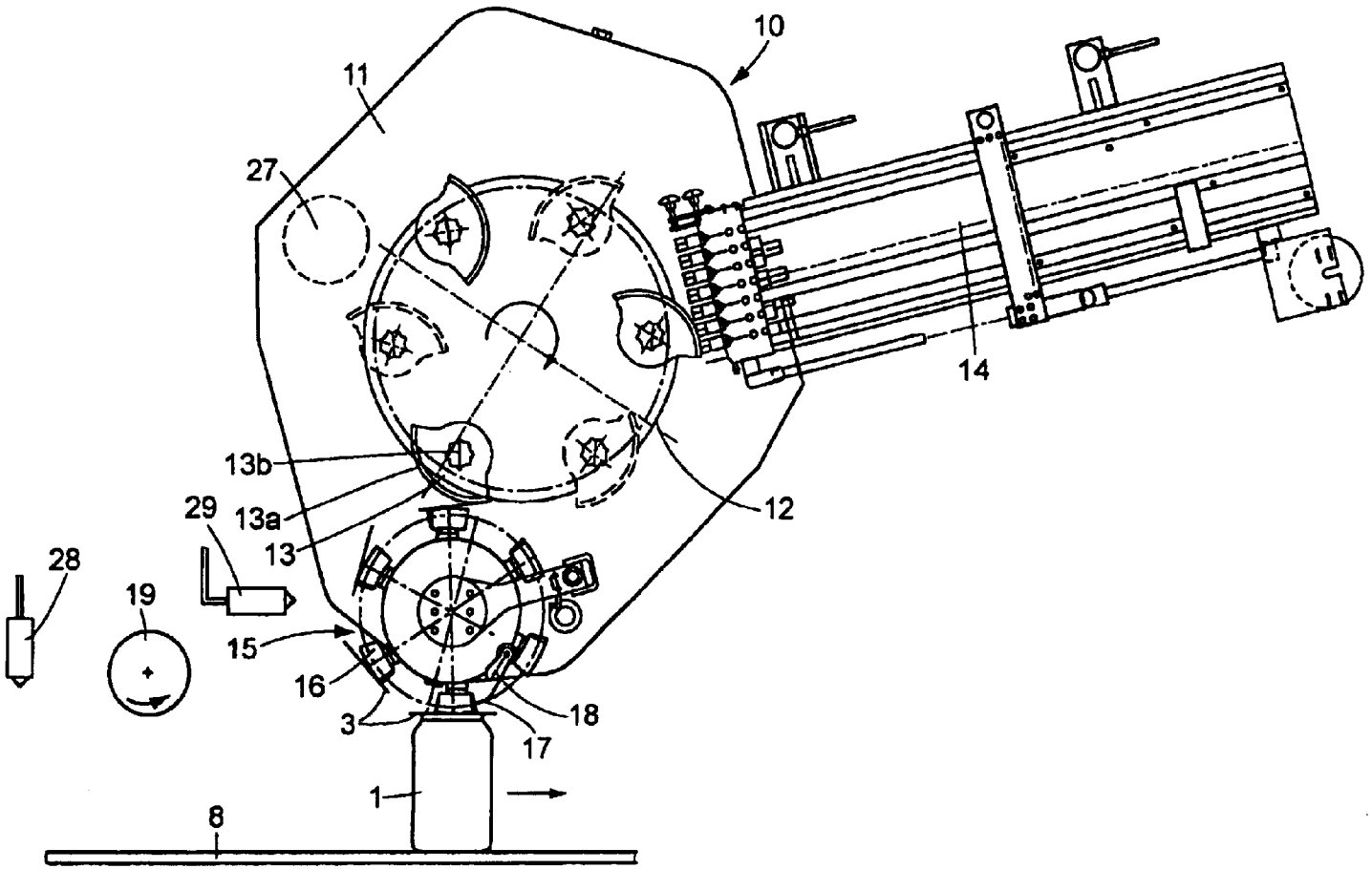
FIG. 3 depicts a side view (in direction of observation X) of the protective cover transfer device of the outfitting machine depicted in FIG. 2.

The side view of the transfer apparatus 10 depicted in FIG. 3 shows that a first motor 12 with several pallets 13 uniformly distributed on a graduated circle is supported in a housing 11. Each of these pallets 13 has a curved contact surface 13*a* which features a multitude of vacuum openings, and is eccentrically secured to an eccentric shaft 13*b* that pivots in the rotor 12. A roll lever, which cannot be depicted in detail, is secured to the end of the shaft 13*b* that protrudes into the housing 11, and its track roller engages a closed curved groove, also not depicted, located in the housing 11. The curve shape determines the oscillating pivoting of the contact surfaces 13*a*, and is designed in such a way as to ensure that when the rotor 12 rotates in the direction of the arrow in the area of a foil blank container 14, which holds the pre-punched protective covers 3 and is arranged in a fixed manner along the periphery of the rotor 12, the contact surfaces roll off against the front foil blank, thereby removing said blank from the container by means of vacuum pressure and then feeding it to a second rotor 15, which is arranged along the periphery of the first rotor 12 and points in the direction of the conveyor belt 8.

This second rotor 15 is designed as a mechanical gripper cylinder with several elastic pressure pads 16 distributed uniformly around its circumference, with each of these pressure pads 16 being allocated to a pivoting gripper finger 17 that is actuated by means of a roll lever 18 in conjunction with a stationary radial cam, which is not depicted. With the gripper finger 17, a protective cover 3 located on a contact surface 13*a* can be removed from the pallet 13 by gripping of the label edge, concentrically positioned, and fastened provisionally to the can lid 1*a* or can edge 1*c* of a can 1 passed beneath the gripper cylinder 13. When viewed in the direction of conveyance in front of the gripper cylinder 13, a rotating glue roll 19 for application to the can edge 1*c* of an adhesive safe for use with food can be arranged at the level of the can lid and above the conveyor 8.

The height of the transfer apparatus 10 is selected in such a way as to ensure that the distance between the upper surface of the conveyor belt 8 and the outer periphery of the revolving elastic pads 16 of the second rotor 15 is somewhat smaller than the height of the closed cans 1, so that at least the flange 1*c* between the can lid 1*a* and the can body id and, preferably, the can lid itself, dips into the flexible pad 15 while passing the second rotor 15, wherein the protective cover 3 being held concentrically to the can lid is pressed at least a few millimeters in the direction of the can lid 1*a*.

Then the can 1 with the provisionally fastened protective cover 3 is fed from the star wheel 6, which features collecting pockets or controllable holding units, to the carousel 5, which features a bottle table, not depicted in greater detail, with several placement spaces 20 arranged on a graduated circle. Each of these placement spaces 20 is allocated to a controlled coupler 21 that can be raised and lowered, and whose end oriented toward the placement space 20 has a centering cone 21 a conforming to the shape of the can shoulder 1*b* and with a sponge pad 22 inserted into it. The inside diameter of the cone-shaped interior space of the centering cone 21 a is to be dimensioned slightly larger than the outside diameter of the can lid la. The elastic sponge pad 22 inserted into the centering cone is designed to conform accordingly to the shape and dimensions of the can lid.

According to FIG. 4.1, the centering cone 211, together with the sponge pad 22 inserted into it, can be raised and lowered while being moved past a carrier 24 which revolves with the placement spaces 20 in angular synchronicity. A cam roller 25 that engages a stationary radial cam 26 is secured to its upper end. The situation at the position at which the cans 1 are transferred from the feeding star wheel 6 to the carousel 5 is depicted in FIG. 4.1. Immediately thereafter, the rotation of the carousel 5 and the carrier 24 causes the coupler 21 to be lowered by the dropping radial cam 26, wherein the can 1 engages the centering cone 21 a and the sponge pad 22 at the top of the lid, so that ultimately the can 1 becomes axially fixed between its base and lid and is centered around its circumference by the centering cone. During this process, a graduated, protruding, round lip of the sponge pad 22 presses the protective cover 3 into the bowl-shaped recess of the can lid 1*a* to conform to its contours, while the edge of the protective cover, or its circumferential portion, is pressed against the diagonal shoulder surface 1*b* of the can body around the flange 1*c* while being fully immersed into the sponge pad 22 (FIG. 4.3).

As the carousel continues to rotate, the centering cone 21*a* and the coupler 21 are moved upward by the radial cam 26. Before it reaches the discharge star wheel 7, the coupler 21 is raised by the radial cam 26, which is rising in this area, until the centering cone 21*a* and its sponge pad 22, together with the can lid 1*a*, are lowered and are subsequently transferred back to the position depicted in FIG. 4.3. Before the fully configured can 1 is transferred to the outgoing conveyor belt, the protective cover 3 can undergo an additional pressure treatment in the area of the discharge star wheel 7 with brushes, sponge rollers, or rotating brushes, which are not depicted.

In FIGS. 4.1 to 4.3, the sponge pad 22 is designed to elastically press the protective cover 3 from the outside against the can shoulder, which is shaped to progress inward in a radial manner. However, the sponge pad can, in a manner not depicted in the figures, be restricted to the actual can lid with its bowl-like recess, so that shaping to conform to the can shoulder is achieved with a centering cone 21*a* made of a rigid material, with the centering cone designed to conform to the can shoulder. The very precise dimensional stability of the cans makes this variation possible.

Diverging from the sample execution described above in connection with FIG. 3, the pallets 13 of the foil transfer apparatus 10 can have contact surfaces that can be coated with glue or water, i.e., that operate without vacuum support. In this case, a rotating glue roller 27 (indicated by dashed lines in FIG. 3), which coats the pallet contact surfaces in a roll-off movement, is arranged along the rotary path of the pallets—viewed in the direction of travel—in front of the foil container 14. The pallet contact surfaces can be provided with raised segments, e.g., a circular segment corresponding to the can edge, to take up the glue.

Figure 5:
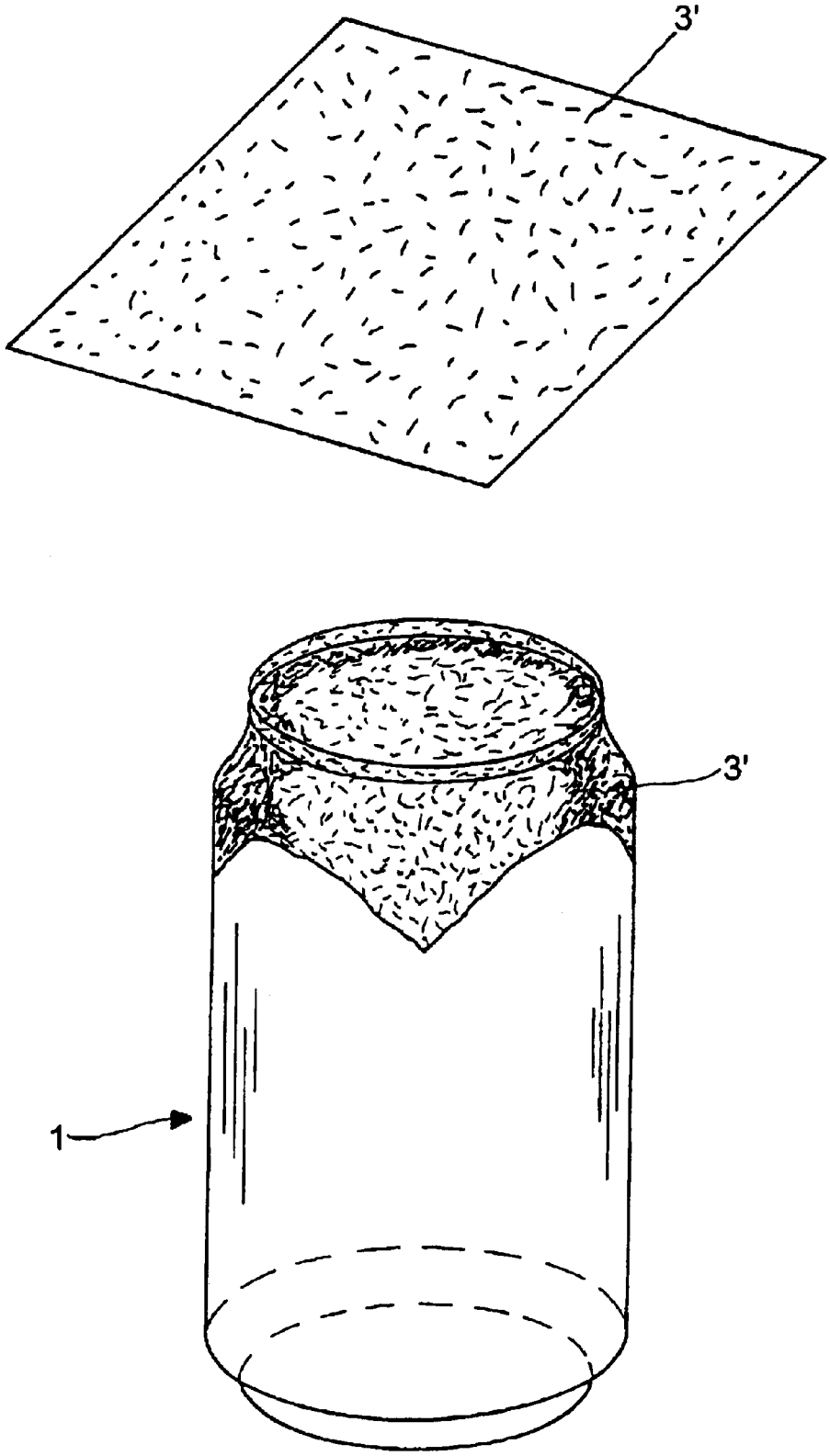
FIG. 5 depicts a beverage can with an alternate form of the protective cover.
Figure 6:
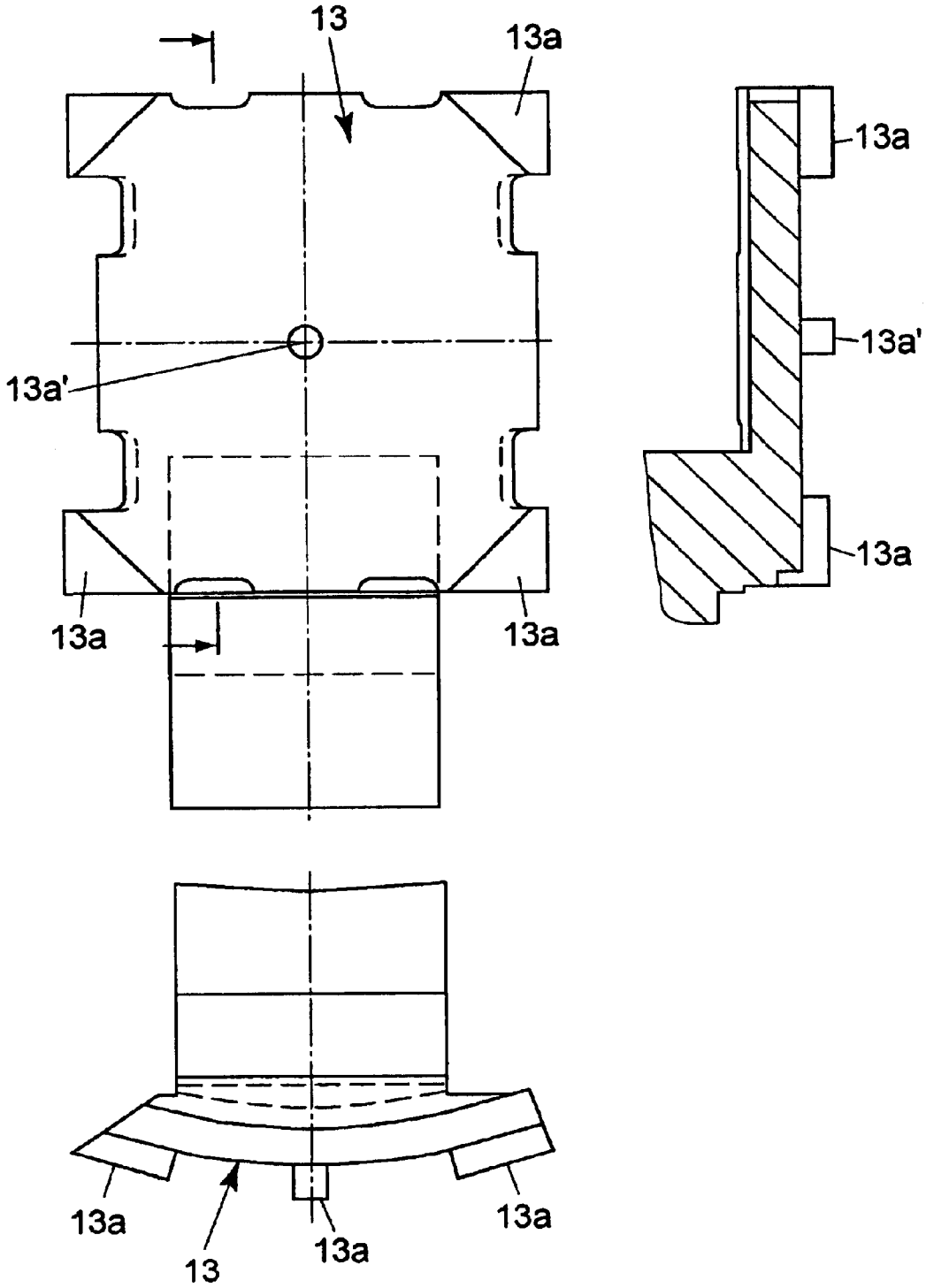
FIG. 6 depicts a pallet of the transfer device according to FIG. 3, with a curved contact surface in a side view, a longitudinal view, and an aerial view.

FIG. 6 depicts a sample execution of a pallet 13 with a contact surface, which can be coated with glue, for a square foil segment corresponding to FIG. 5. The pallet 13 according to FIG. 6 is designed so that essentially triangular contact zones 13*a* are created in three corner areas and a small circular contact zone 13*a*' is created in the center by shaping the aforementioned zones to protrude in radial fashion in relation to the pallet body. During roll-off of the glue roller 27 indicated in FIG. 3, only these contact zones 13*a* and 13*a*' take up glue or are coated with water, which means that only the corresponding areas of the back side of a foil blank are coated with glue or water.

The sample execution according to FIG. 5 differs from that depicted in FIG. 1 in that, here, the protective cover 3' consists in a square foil blank, the manufacture of which is particularly cost-effective. The protective cover 3' is manufactured in the same manner as the circular protective cover 3 depicted in FIGS. 2 to 4. Once it has been completely molded into place, the protective cover 3' forms four points that progress downward along the can shoulder 1*b* or the can body (1*d*). This creates the image of the so-called "point tin foil covering" commonly used on beer bottles with high-quality contents. In addition, the points serve as pull-off tabs. If a transfer apparatus 10 with pallets 13 of the type depicted in FIG. 6 is used, an adhesive bond exists between three points and the can shoulder, while the fourth non-glued point serves as a pull-off tab.

It is also conceivable that the diameter of a protective cover 3 made from a circular blank according to FIG. 1 be reduced, so that the protective cover essentially covers only the can lid 1*a* and, possibly, the can edge 1*c*. In this case, it is advantageous to provide at least one pull-off tab 23, as indicated by the dot-dash lines, preferably with a tangential interface to the circular shape.

According to an enhancement of the invention, foil blanks can be used that feature, imprinted onto the side facing the can, an adhesive coating that can be activated or a wax coating. Depending on the application, the adhesive or wax coating can cover either the entire surface or only parts thereof. Adhesives that can be activated by heat or by water application may be used. A suitable adhesive, for example, is a heat-sealing enamel made of a PVC/PVAC copolymer, mixed with a polyaurylate. The preferable range of application of the sealing enamel is from 0.5 to 5 grams per square meter. Suitable water-activated adhesives are gum arabic, polyvinyl alcohol, polyvinyl acetate, dextrin, or synthetic resin dispersions. These adhesives can also be applied in a cost-effective manner to the reverse side of the blanks during their manufacture.

Figure 7:
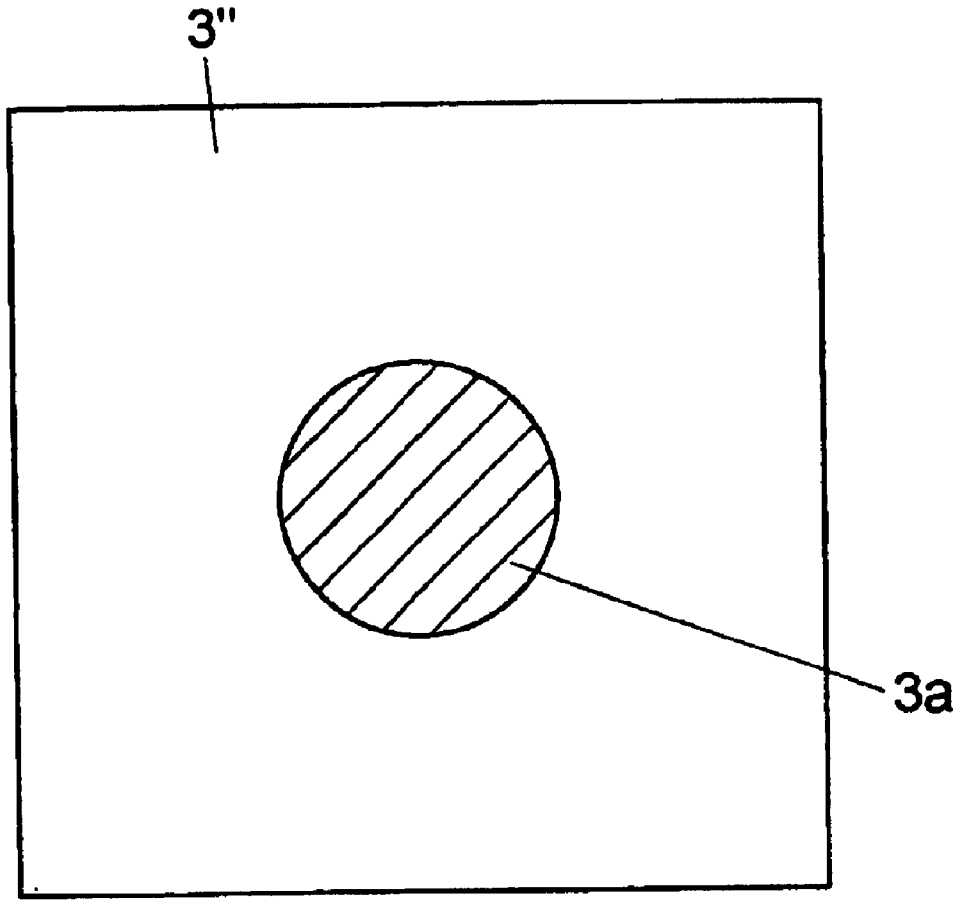
FIG. 7 depicts a blank for a protective cover of a beverage can.

FIG. 7 depicts the reverse side of a square foil blank 3' that features a circular, heat-activated adhesive imprint 3*a* in its center. To activate this adhesive imprint, an activating apparatus 29, e.g., a pulsed laser, which shines onto the can lid from above, is arranged in the feeding area of the transfer apparatus 10, in front of the gripper cylinder 15 and above the can conveyor belt (FIG. 3), which activating apparatus briefly heats the passing can lids to a sufficient degree to ensure that, while the foil blank 3' is being pressed into place by the gripper cylinder, the adhesive imprint 3*a* is activated by heat transfer from the can lid, resulting in an adhesive bond. Alternatively or additionally, activation can occur in the rotary zone of the gripper cylinder 15, e.g., by means of electrically heated pressure pads 16, heating elements 29 that are radially oriented from the exterior toward the foil blanks 3 being held by the gripper cylinder, lasers, or similar devices. Pallets 13 with a vacuum contact surface can be used for removal of the foil blanks depicted in FIG. 7. In this case, it may be possible to completely do without glue application devices, such as the glue rollers 19, 27.

What is claimed is:

1. Device for application of protective covers (3) to a lid area of a beverage can (1), comprising in combination a conveyor apparatus (5, 8) for conveying the cans in an upright orientation, and a placement apparatus (10) arranged above said conveyor apparatus for placing protective cover blanks made of embossed aluminum foil, said placement apparatus operable to place one cover of said protective cover blanks onto the lid area of each of the cans from above while pressing and conforming said one cover, at least partially, against the lid area or an edge of the can adjacent the lid area in a ductile manner.

2. Device according to claim 1, wherein said placement apparatus (10) for placing said protective cover (3) is located upstream from at least one press-on apparatus which is operable to mold said protective cover to the lid area or shoulder area of the cans (1).

3. Device according to claim 1, and including a device (27) for applying adhesive to said blanks.

4. Device according to claim 1, and including a device (29) for zonal heating of the blanks.

5. Device according to claim 1, and including a device (19) for applying adhesive to the beverage cans.

6. Device according to claim 1, and including a device (28) for zonal heating of the beverage can (1).

7. Device according to claim 6, wherein said zonal heating of the beverage can occurs at the can lid (1*a*).

* * * * *